US008109027B2

(12) United States Patent
Cragg

(10) Patent No.: US 8,109,027 B2
(45) Date of Patent: Feb. 7, 2012

(54) WEAPON FOREND SUPPORT PAD

(75) Inventor: James Victor Cragg, Carson, CA (US)

(73) Assignee: S.O. Tech Special Operations Technologies, Inc., Carson, CA (US)

( * ) Notice: Subject to any disclaimer, the term of this patent is extended or adjusted under 35 U.S.C. 154(b) by 190 days.

(21) Appl. No.: 12/313,365

(22) Filed: Nov. 19, 2008

(65) Prior Publication Data

US 2012/0005930 A1 Jan. 12, 2012

Related U.S. Application Data

(60) Provisional application No. 61/003,696, filed on Nov. 19, 2007.

(51) Int. Cl.
*F41C 23/08* (2006.01)

(52) U.S. Cl. ..... 42/94; 42/73; 42/74

(58) Field of Classification Search ..... 42/94, 73, 42/74

See application file for complete search history.

(56) References Cited

U.S. PATENT DOCUMENTS

| | | | | | |
|---|---|---|---|---|---|
| 4,004,683 | A * | 1/1977 | Pomeroy et al. | 206/3 |
| 4,947,573 | A * | 8/1990 | Bischoff | 42/106 |
| 5,265,365 | A * | 11/1993 | Finn | 42/74 |
| 5,678,345 | A * | 10/1997 | Gnade | 42/97 |
| 5,771,622 | A * | 6/1998 | Koziuk et al. | 42/74 |
| 6,254,582 | B1 * | 7/2001 | O'Donnell et al. | 604/385.05 |
| 6,397,507 | B1 * | 6/2002 | Marshall et al. | 42/72 |
| 2010/0327004 | A1 * | 12/2010 | Post | 221/46 |

* cited by examiner

*Primary Examiner* — Stephen M Johnson
(74) *Attorney, Agent, or Firm* — Cislo & Thomas, LLP

(57) ABSTRACT

A weapon support pad comprising a pad comprising a fastening mechanism to attach to the forend of a weapon, such as a rifle to provide support and absorb unwanted vibrations, among other advantages. The pad may be quickly and easily attachable and detachable from the weapon. A variety of fastening mechanisms may be utilized, including the hook-and-loop.

6 Claims, 5 Drawing Sheets

WEAPON FOREND SUPPORT PAD

CROSS-REFERENCE TO RELATED APPLICATION

This patent application claims the benefit of U.S. Provisional Patent Application Ser. No. 61/003,696, entitled "Weapon Forend Support Pad," filed Nov. 19, 2007, which application is incorporated in its entirety here by this reference.

BACKGROUND OF THE INVENTION

1. Technical Field

This invention relates to firearm equipment.

2. Background Art

Those accustomed to using guns, particularly rifles and shotguns, such as the military, law enforcement, and hunters, are familiar with the recoil action, or the backward kick, of the gun upon discharge. That recoil is generally absorbed by the shooter either into his shoulder or through his hands. Such recoil can negatively effect the shooter's next shot.

In addition, the shooter is also subject to slight movements that could affect the accuracy of the shot. For example, nervous energy due to adrenaline or slight movements of the hand due to a normal heartbeat could both affect the accuracy of a shot. This is particularly true for sharp shooters or snipers who require extreme steadiness for pinpoint accuracy.

Some firearms have been designed to inherently absorb the recoil; however, manufacture of such firearms increases cost. In addition, this would be of no use to pre-existing guns.

Thus, there exists a need for an apparatus to absorb the recoil of a firearm and to provide the ability to hold a gun steady that is versatile and affordable.

BRIEF SUMMARY OF INVENTION

The present invention is directed to a weapon forend support pad that can absorb the recoil of a discharged firearm and the minute movements of the user. The weapon forend support pad comprises a pad and a means for attaching the pad to the firearm in a quick and efficient manner. The weapon forend support pad can be made of any material that can absorb the energy created by a discharged firearm. For example, the weapon forend support pad may comprise rubber or foam.

DETAILED DESCRIPTION OF THE INVENTION

The detailed description set forth below in connection with the appended drawings is intended as a description of presently-preferred embodiments of the invention and is not intended to represent the only forms in which the present invention may be utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1A:
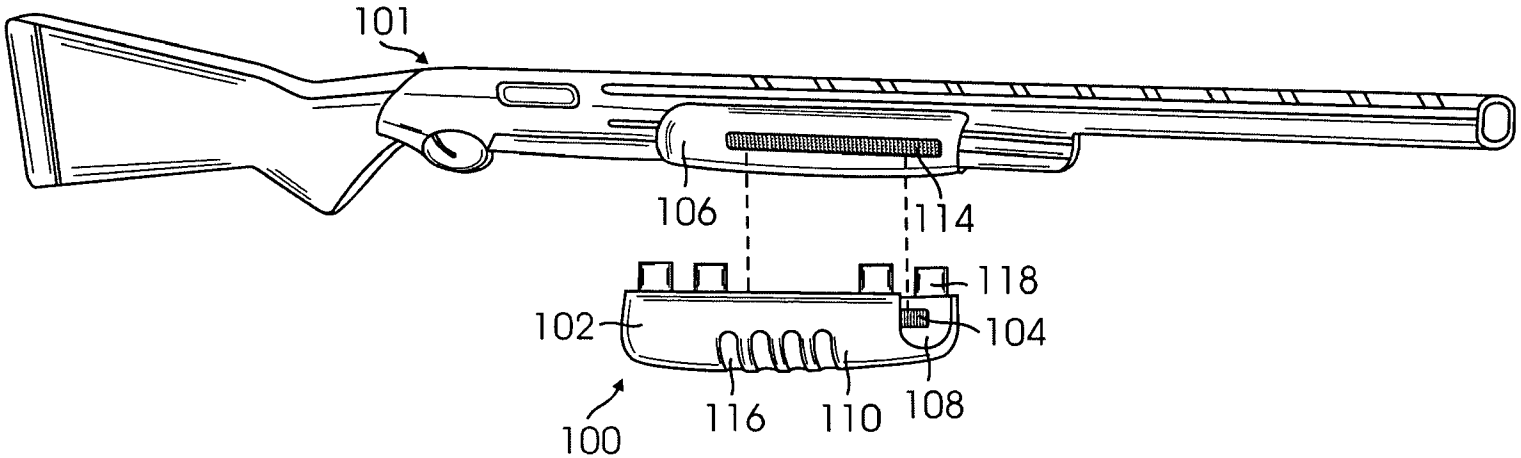
FIG. 1A is a perspective view of an embodiment of the present invention shown with a firearm.
Figure 1B:
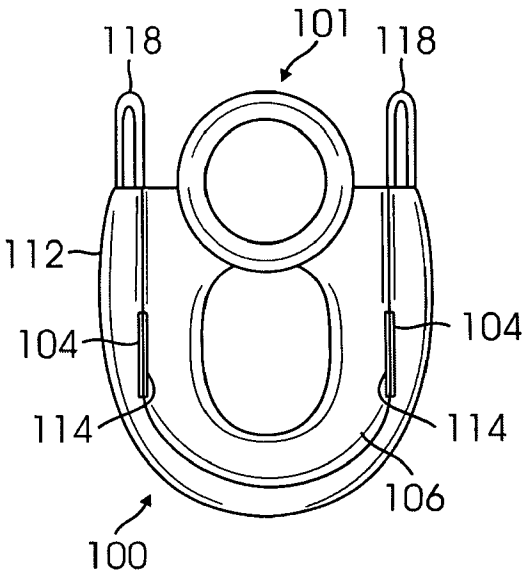
FIG. 1B is a front view of an embodiment of the present invention attached to a firearm.

The weapon forend support pad 100 is designed to absorb unwanted forces, such as the recoil of a firearm being fired or the slight vibration in the hands created by a heart beat or a pulse. As shown in FIGS. 1A and 1B, the weapon forend support pad 100 comprises a pad 102 with an attachment means or a means for attaching 104 to attach to the forestock or forend 106 of a firearm 101, such as a gun, rifle, shotgun, machine gun, and the like. The pad 102 comprises an engagement surface 108 and a grip surface 110. The pad 102 may comprise any vibration absorbing material such as foam, cork, elastomer or any combination thereof. For example, the pad 102 can be made of rubber or it can be made of foam made from polyurethane. Any other material that can absorb and disperse the unwanted forces would be suitable material for the pad. The weapon forend support pads 100 may be disposable or reusable.

The pad 102 may be cut into a square or rectangular piece so as to partially wrap or partially cover the forend 106 of a firearm. Other suitable shapes can be used so long as the shape is configured to wrap around the forend of the firearm. For example, the shape may be square, oval, round, triangular, and the like. Regardless of the precise shape, the pad comprises two lateral edges 204, 206, a front edge 208 adjacent to the two lateral edges 204, 206, and a rear edge 210 opposite the front edge 208 and adjacent to the two lateral edges 204, 206, wherein the pad 102 is bendable to form a "U"-shaped cross-section so as to partially wrap around the forend 106 of the weapon with the engagement surface engaging the forend. Alternatively, the pad 102 may be formed to fit the forend 106 of a rifle.

In some embodiments, the pad 102 may be covered, wrapped, or enveloped in a cover 112. The cover 112 may be made from any durable material or fabric that is resistant to slippage, such as cloth, leather, nylon and the like, to provide durability and stability. In some embodiments, viscous fluids encased in a cover 112 may also be suitable, in which case the cover may be lined with water-proof lining. In embodiments utilizing the cover 112, the attachment means or means for attaching 104 would be on the cover 112 rather than the pad 102.

The engagement surface 108 engages with the forend 106 of a rifle. In embodiments comprising a cover 112, the engagement surface 108 and grip surface 110 refers to the cover 112 portion adjacent to the engagement surface 108 and grip surface 110, respectively. The engagement surface 108 may comprise a fastening mechanism or means for attaching 104 that allows for quick attachment and detachment of the pad to the forend 106, such as hook-and-loop fasteners, snap buttons, grommets, tongue and groove, non-slip pads, non-skid material, magnets and any other mechanisms that would provide traction, resistance, adhesion, friction or the like, between the forend 106 and the pad 102 or cover 112.

The forend 106 may be lined with the reciprocal fastening or attachment mechanism 114. The reciprocal attachment mechanism 114 may be permanently or temporarily attached to the forend 106. For example, in the hook-and-loop embodiments, the forend 106 may be permanently lined with either the hook or the loop and the engagement surface 108 may be permanently lined with the loop or the hook, respectively.

Figure 2A:
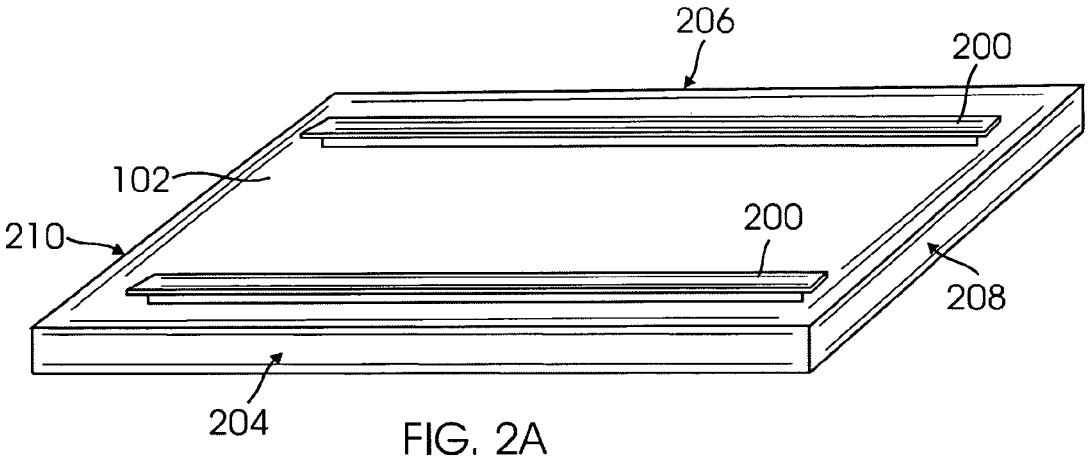
FIG. 2A is a perspective view of another embodiment of the present invention.
Figure 2B:
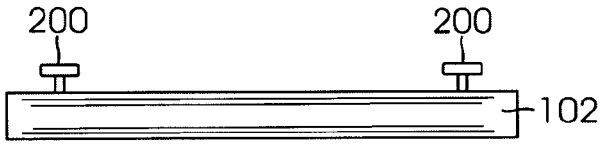
FIG. 2B is a front view of the embodiment shown in FIG. 2A.
Figure 2C:
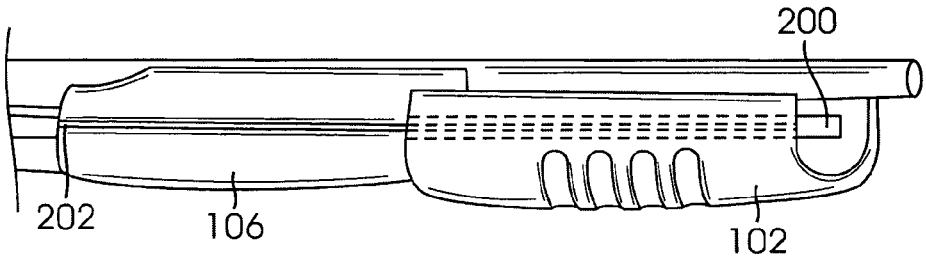
FIG. 2C is a perspective view of the embodiment shown in FIG. 2A being installed on a firearm.

In some embodiments, the reciprocal fastening mechanism 114 may be an integral part of the forend 106. For example, the forend 106 may have grooves 202 and the engagement surface 108 may have a tongue 200 to slide into the groove 202, as shown in FIGS. 2A-2C. Conversely, the forend 106 may have the tongue 200 and the engagement surface 108 may have the groove 202.

Figure 3A:
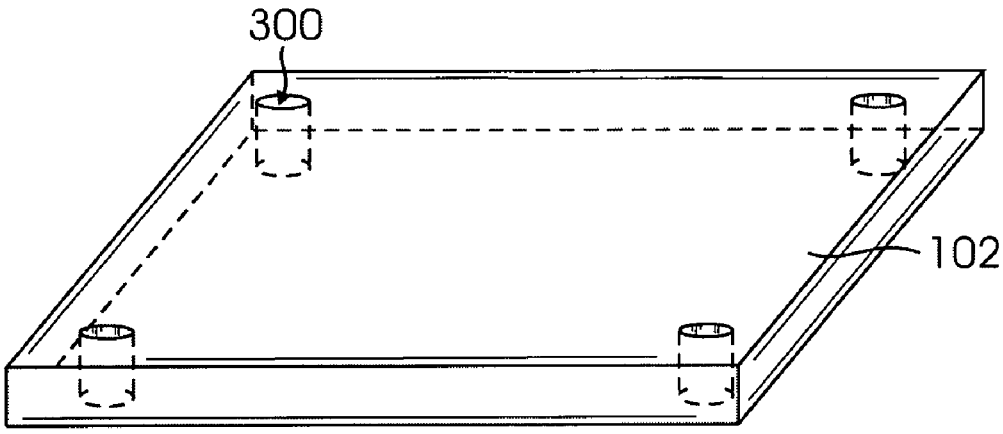
FIG. 3A is a perspective view of another embodiment of the present invention.
Figure 3B:
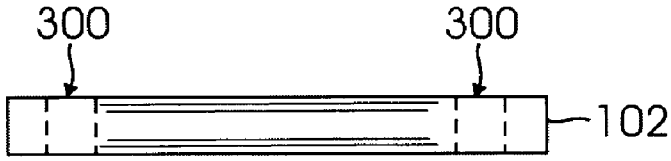
FIG. 3B is a front view of the embodiment shown in FIG. 3A.
Figure 3C:
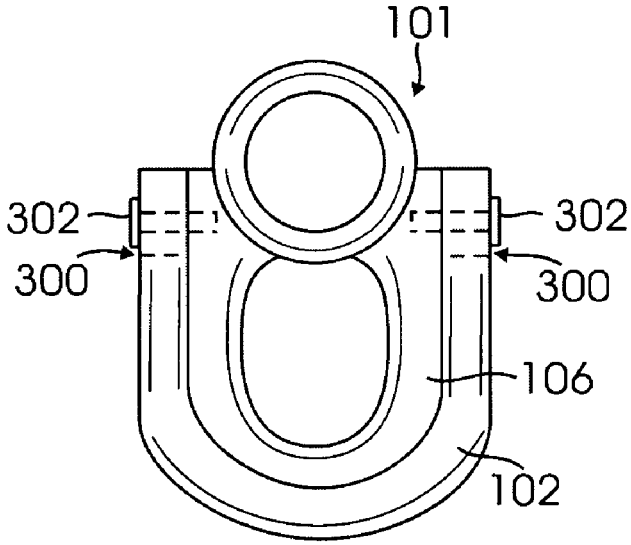
FIG. 3C is a front view of the embodiment shown in FIG. 3A installed on a firearm.

Alternatively, if grommets 302 are used as the fastening mechanism 104 on the engagement surface 108, then holes or hooks 300, to which the grommets 302 can be fitted, may be permanently machined into the forend 106. Conversely, the grommets 302 may be permanently or removably attached to the forend 106 and the holes 300 or hooks can be created on the engagement surface 108, as shown in FIGS. 3A-3C.

The attachment mechanisms 104 may be lined anywhere along the engagement surface 108 such that engagement with the forend 106 will prevent or minimize slipping between the pad 102 and the forend 106. The amount of surface area covered by the fastening mechanism 104 may depend on the strength of the fastening mechanism. For example, the hook or the loop portion of a hook-and-loop may be lined longitudinally along two lateral sides of the pad 102 on the engagement surface 108. The loop or the hook portion of the hook-and-loop may substantially cover the entire surface of the forend 106. In embodiments utilizing non-slip pads, the entire engagement surface 108 and the forend 106 may be made of the non-slip material. In embodiments using snap buttons or grommets, only the four corners of the engagement surface 108 may require the fastening mechanism 104. Increasing the number of points of contact, however, would increase the strength of the contact.

The grip surface 110 may be smooth or ergonomically designed to be comfortably and securely grasped with one hand. For example, the grip surface 110 may have grooves 116 or projections or bumps. Alternatively, the grip surface may be lined with any material that has particular traction with the hand.

In embodiments with grooves 116 or projections, the grooves 116 or projections may also provide guidance for proper hand placement.

In some embodiments, the pad 102 or cover 112 may further comprise loops 118, hooks, or rings. The loops 118 may be made of any durable material such as metal, plastic, leather, fabric, or the like. In some embodiments, the loop is made of nylon. The loops provide a suspension system as an additional means for suspended shooting. For example, straps secured to a ceiling may be attached to the loops 118 to provide further stability while holding the rifle 101. This may be particularly important if the user is shooting from a moving vehicle such as a helicopter.

Figure 4A:
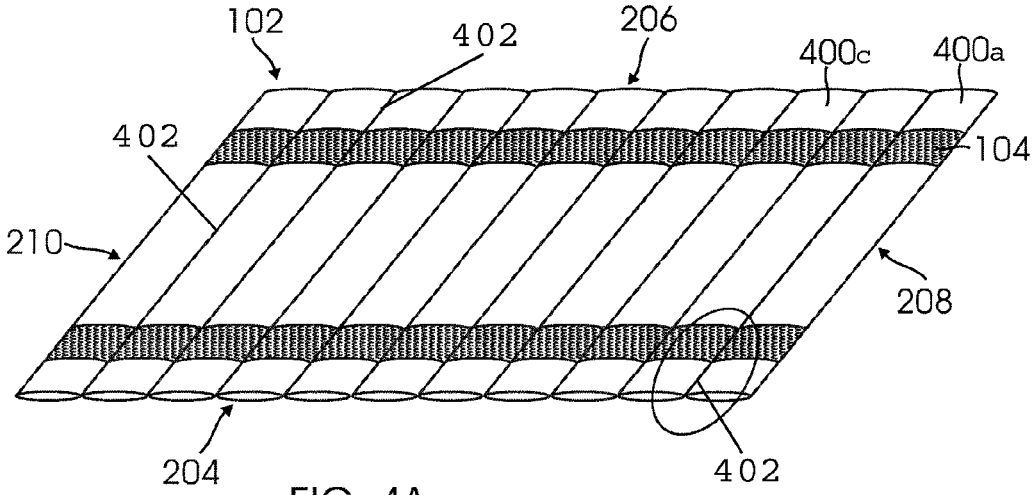
FIG. 4A is a perspective view of another embodiment of the present invention.
Figure 4B:
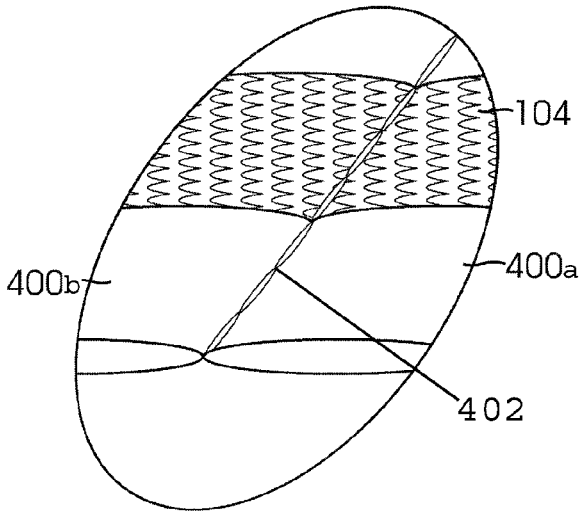
FIG. 4B is a close-up of the circled portion shown in FIG. 4A.
Figure 5:
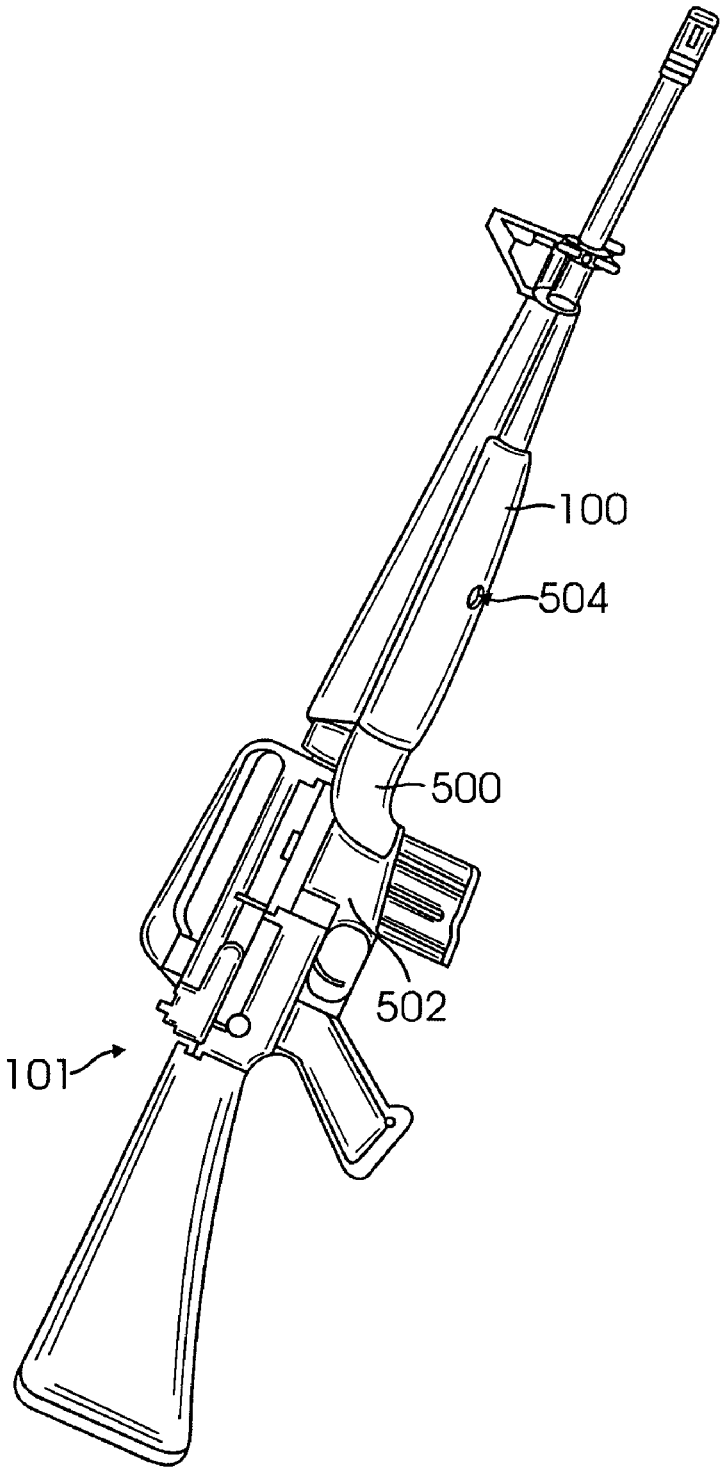
FIG. 5 is a perspective view of another embodiment of the present invention.

In some embodiments, the pad 102 may be provided as a plurality of detachable sections 400, as shown in FIGS. 4A and 4B. The detachable sections 400 may be permanently detachable or reversibly detachable. In embodiments with covers, each section 400 may be secured or sealed in a separate cover 112. Each separate cover 112 may be connected to another through perforated attachments, weak stitching, or some other form of weak attachment that can be easily ripped or torn off. Alternatively, in embodiments without covers 112, the pads 102 may be attached to each other through perforated attachments, weak stitching, or some other form of weak attachment that can be easily ripped or torn off. To remove a first detachable section 400*a* from an immediately adjacent section 400*b* of the plurality of detachable sections 400, the user need only tear the detachable section 400 or cover 112 at its weakest connection, such as the perforations, stitching, or the like, thereby effectively decreasing the overall size of the weapon forend support pad 100. Therefore, the size of the weapon forend support pad 100 may be adjusted to accommodate rifles of various sizes.

FIGS. 4A and 4B show a series of perforations extending laterally across a planar or flat pad 102 perpendicular to the length of the forend 106, forming lines of perforation 402. Thus, each section 400 is a lateral section and tearing of each lateral section makes the overall length of the pad shorter and shorter for rifles with shorter forends. In some embodiments, the perforations may extend longitudinally, parallel to the forend. Tearing off sections of this embodiment makes the pad 102 narrower.

In embodiments with reversibly detachable sections, the pads 102 or covers 112 may be attached to each other by reversible attachment means such as the hook and loop, zippers, buttons, adhesives, and the like.

In some embodiments, the weapon forend support pad 100 further comprises an auxiliary pad 500. The auxiliary pad 500 may be an extension of the pad 102 at a perimeter edge, such as the rear edge 210 or the front edge 208, to provide additional support at different portions of the firearm 101. For example, in an M-16 rifle the weapon forend support pad 100 may be wrapped around the forend 106 and the auxiliary pad 500 may rest up against the magazine chamber 502. In some embodiments, the auxiliary pad 500 may be formed integrally with the weapon forend support pad 100. In some embodiments, the auxiliary pad 500 may be a separate piece with means to attach to the weapon 101 and the weapon forend support pad 100.

In some embodiments, the weapon forend support pad 100 may be configured to receive a support device, such as a monopod, bipod, or tripod. The pad may have a receiving orifice 504 for the secure insertion of the support device.

Thus, a user can attach a weapon forend support pad 100 onto his weapon 101 and mount the weapon forend support pad 100 on a surface to improve shooting off any type of surface including unconventional surfaces, and in unconventional positions. Without a weapon forend support pad 100, a user may place the forend 106 on a hard surface such as a window sill, a brick wall, the hood of a car, and the like. Upon discharge of the firearm, the hard forend 106 of the firearm may reverberate or bounce on top of the surface potentially damaging the firearm. With the weapon forend support pad 100, the reverberations are absorbed into the pad 102, thereby reducing damage to the firearm and minimizing recoil felt by the user. This provides positional integrity for the user to allow for more accurate shots.

Thus, a method is provided to absorb recoil, maintain positional integrity, provide hand placement reminder, provide suspension system for suspended shooting, and provide improved mount for shooting off unconventional surfaces and unconventional positions. The support pad can be mounted, removed and replaced quickly and easily and does not require gunsmithing for installation or retrofitting.

The foregoing description of the preferred embodiment of the invention has been presented for the purposes of illustration and description. It is not intended to be exhaustive or to limit the invention to the precise form disclosed. Many modifications and variations are possible in light of the above teaching.

What is claimed is:

1. A weapon forend support pad designed to absorb unwanted forces, comprising a. a pad having an engagement surface and a grip surface, the pad configured to partially wrap around the forend of the weapon, wherein the pad comprises a plurality of detachable sections, wherein a first section of the plurality of detachable sections is detachable from an immediately adjacent section of the plurality of detachable sections at a line of perforation to change a size of the pad; and b. a means for attaching to attach the pad to the forend of the weapon.

2. The weapon forend support pad of claim 1, wherein the means for attaching is selected from the group consisting of a hook-and-loop fastener, a snap button, a grommet, a tongue and groove, a non-slip pad, a non-skid material, and a magnet.

3. The weapon forend support pad of claim 1, further comprising a cover to encase the pad, wherein the means for attaching is on the cover.

4. The weapon forend support pad of claim 1, wherein the grip surface comprises deformations for ergonomic grasp of the pad.

5. The weapon forend support pad of claim 1, wherein the plurality of detachable sections are attached with a reversible attachment.

6. The weapon forend support pad of claim 1, wherein the pad is planar and the first section of the plurality of detachable sections forms a lateral section relative to the immediately adjacent section.

* * * * *